US009987536B2

(12) United States Patent
Nash

(10) Patent No.: US 9,987,536 B2
(45) Date of Patent: Jun. 5, 2018

(54) NETS FOR COLLAPSIBLE SPORTS GOALS

(71) Applicant: Kevin Nash, Bonita, CA (US)

(72) Inventor: Kevin Nash, Bonita, CA (US)

( * ) Notice: Subject to any disclaimer, the term of this patent is extended or adjusted under 35 U.S.C. 154(b) by 0 days. days.

(21) Appl. No.: 14/925,971

(22) Filed: Oct. 28, 2015

(65) Prior Publication Data

US 2017/0120125 A1 May 4, 2017

(51) Int. Cl.
*A63B 63/00* (2006.01)

(52) U.S. Cl.
CPC ..... *A63B 63/004* (2013.01)

(58) Field of Classification Search
CPC ..... A63B 63/04; A63B 63/00
USPC ..... 473/478; 273/396
See application file for complete search history.

(56) References Cited

U.S. PATENT DOCUMENTS

| | | | | |
|---|---|---|---|---|
| 5,080,375 | A | 1/1992 | Moosavi | |
| 5,549,304 | A * | 8/1996 | Davis | A63B 63/004 273/396 |
| 6,652,395 | B2 | 11/2003 | Goldwitz | |
| 2004/0072634 | A1 * | 4/2004 | Webb | A63B 63/004 473/478 |
| 2006/0273521 | A1 | 12/2006 | Nash | |
| 2009/0258735 | A1 | 10/2009 | Nash | |
| 2013/0303313 | A1 * | 11/2013 | Chen | A63B 63/004 473/478 |

* cited by examiner

*Primary Examiner* — Gene Kim
*Assistant Examiner* — Christopher Glenn
(74) *Attorney, Agent, or Firm* — Buche & Associates, P.C.; John K. Buche; Bryce A. Johnson

(57) ABSTRACT

Disclosed is a netted sports goal which telescopically collapses or expands in the vertical, horizontal, or longitudinal planes. The net of the sports goal is configured to collapse or expand with the frame of the goal.

6 Claims, 12 Drawing Sheets

NETS FOR COLLAPSIBLE SPORTS GOALS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of Invention

The subject matter of this document relates generally to sports scoring standards or goals. More specifically, the subject matter of this disclosure relates to a sports goal frame and related net supported by said frame. Together, the disclosed net and frame can be a goal frameworks for impromptu or official sporting events utilizing netted scoring standards, such as soccer and hockey, which employ a net supported by a metal frame with an aperture for a ball or puck to pass through and be caught by the supported net.

In preferred embodiments, the disclosed subject matter may be a multi-axis, telescopically collapsible and adjustable goal structure that can be easily erected and collapsed without tools within the vertical, horizontal and longitudinal axises; and, which provides for simple installation and removal, especially in temporary sporting situations in parks, yards, beaches and other areas. In said preferred embodiments, the goal structure and net may be easily stored in the collapsed state and then easily repositioned on the sports field of play. The disclosed goal structure and net can provide for permanent net attachment and may be used for different sports or games by adjusting the height, width or length of the structure through the use of interconnected telescoping crossbars.

Games, like hockey and soccer, that involve the use of a netted goal are traditionally played or practiced on an established, professionally maintained, permanent rink or playing field. For amateurs, the generally flat surface of a playground, field, driveway, or street can also be informally used as a playing area for such games. Whenever such informal playing areas host a game, goal frames and netting must be transported to and from the playing areas. Such equipment must also be stored when not in use. In view of the foregoing, many attempts have been made to create a simple, easily constructed and easily removable portable version of such a netted goal, each with the intent to provide convenience, portability, compact storage and transport.

One elegantly designed, collapsible, and portable netted goal is disclosed in U.S. Pub. Pat. App. No. 2009/0258735 by Nash. That document describes a sports goal which telescopically collapses or expands independently in any of the vertical, horizontal, or longitudinal planes. Referring to the figures of that document, one point of novelty for this goal is unique rotatably pivoting collars (43) on the central support member (38) that allow for such action. Because of the unique collars, the disclosed goal is capable of assuming a variety of shapes, e.g., tall and narrow goal; short and narrow; short, narrow and shallow; short, wide and shallow; or tall, wide and deep when fully expanded. Other configurations are also possible. Thus, the goal is susceptible to use in settings of varied space and restricted zones of play.

Despite its elegance and utility, the sports goal of Nash has a few deficiencies. First, netting for Nash's old goal that snugly fit a fully expanded configuration of the goal structure became slack and easily tangled in any of the collapsed configurations. Second, the central support member of Nash's old goal is often targeted for players shooting balls or pucks on goal, but while centrally aligned in a fully expanded configuration of the goal structure, the central support member becomes off-centered in collapsed configurations. Thus, a need exists for netting that can accommodate all configurations of a goal with reduced slack and a central support member that can indeed be "central" in all collapsed configurations.

With respect to the above description, before explaining at least one preferred embodiment of the invention in detail, it is to be understood that the invention is not limited in its application to the details of construction and to the arrangement of the components or steps set forth in the following description or illustrated in the drawings, nor just to buildings. The apparatus and methods of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present disclosed device. It is important, therefore, that the objects and claims be regarded as including such equivalent construction and methodology insofar as they do not depart from the spirit and scope of the present invention. Further objectives of this invention will be brought out in the following part of the specification, wherein detailed description is for the purpose of fully disclosing the invention without placing limitations thereon.

BRIEF DESCRIPTION OF THE FIGURES

The manner in which these objectives and other desirable characteristics can be obtained is explained in the following description and attached figures in which.

DETAILED DESCRIPTION OF PREFERRED EMBODIMENTS

Figure 1:
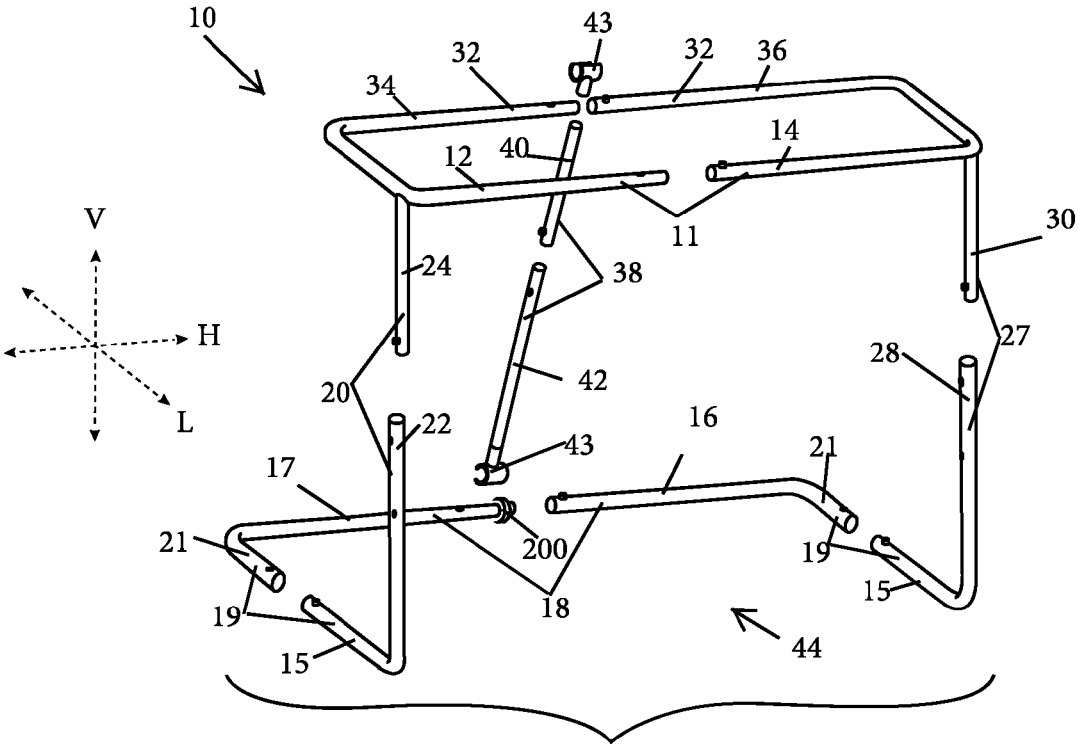
FIG. 1 displays an exploded view of a preferred embodiment of the device collapsible along three axises employing the telescopic translating engagement of the other embodiments with base struts also being telescopic.

FIG. 1 displays an exploded view of an alternate embodiment of the device 10 wherein such is collapsible in three directions along the vertical V, longitudinal L, and horizontal H axises. As discussed later in connection with FIGS. 3 and 5 through 12, the device 10 is collapsible to a collapsed configuration to just over ½ its expanded size (by volume) thereby making it very easy to set up and to collapse later for storage. As discussed below in more detail, collapsibility is accomplished via telescopic means at strategic positions around the supporting structure of the device 10. Of course, additional smaller members making up the various telescopic components may make the device 10 collapsible to a smaller collapsed position and such is anticipated. The current preferred mode typically collapses along its axises via two telescoping components, for simplicity and to avoid the problems inherent to more moving parts.

Figure 2:
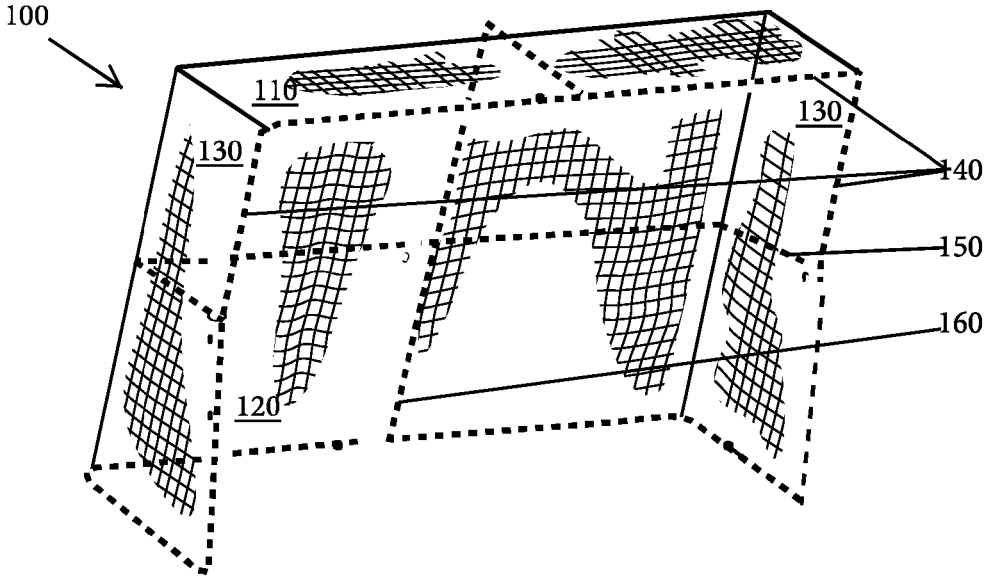
FIG. 2 depicts a net for the device depicted in FIG. 1.

FIG. 2 depicts a net 100 for engaging the device 10 of FIG. 1. As shown, the net 100 is generally defined by a top panel 110, back panel 120, and side panels 130. The panels 110, 120, 130 may be seamlessly interconnected as shown. In a preferred embodiment, the netting 100 features: (1) an elastic cord 140 (shown in broken line) sewn into its edges; (2) an equatorial elastic cord 150 (shown in broken lines) sewn horizontally through its mid-section; and (3) a latitudinal elastic cord 160 (shown in broken lines) sewn through its vertical midsection. As discussed below, the net 100 is configured to engage the device 10 of FIG. 1.

Figure 3:
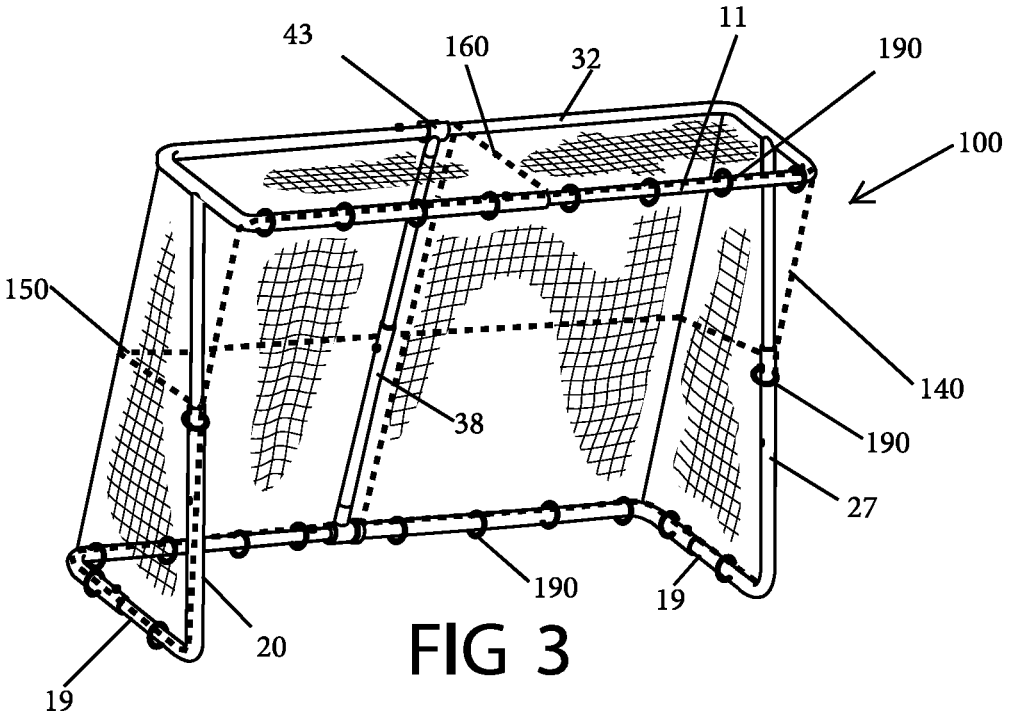
FIG. 3 depicts the device in an expanded position with net of FIG. 2 engaged.
Figure 4:
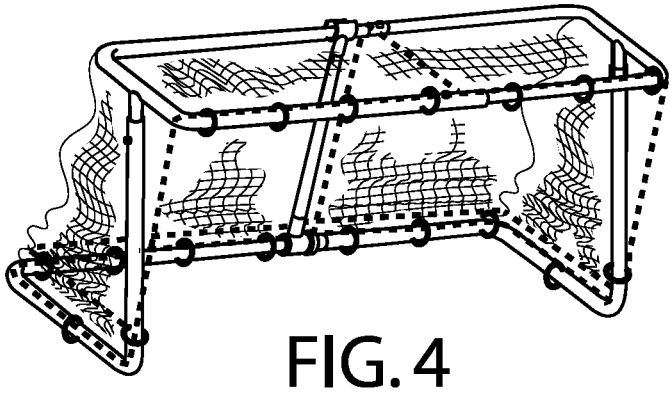
FIG. 4 provides a perspective example of the device in a collapsed configuration where the net may remain engaged.
Figure 5:
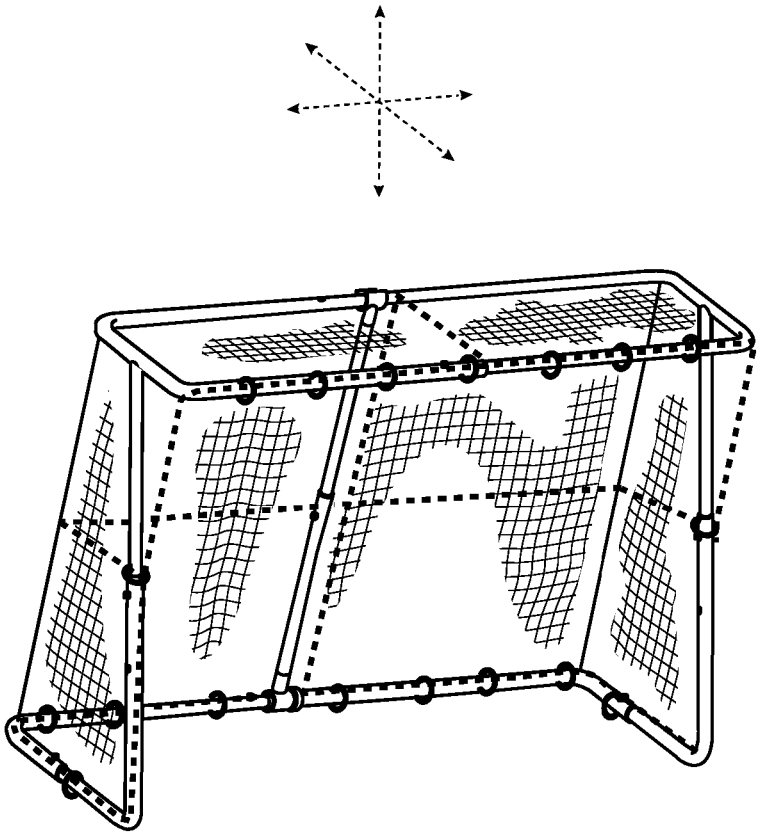
FIG. 5 is a configuration of the sports goal.
Figure 6:
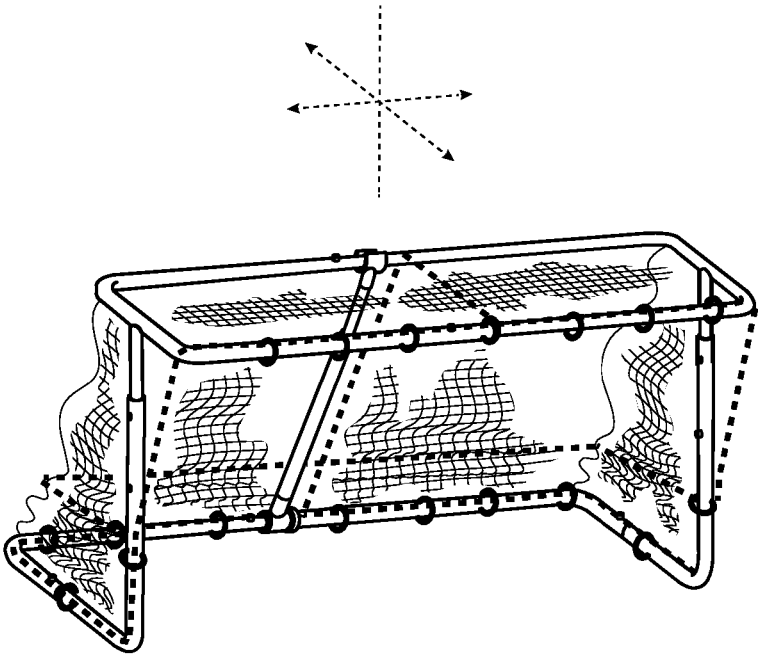
FIG. 6 is a configuration of the sports goal.
Figure 7:
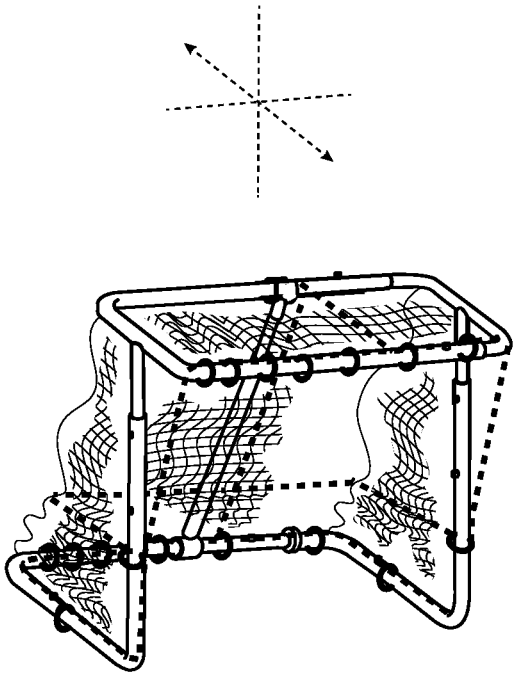
FIG. 7 is a configuration of the sports goal.
Figure 8:
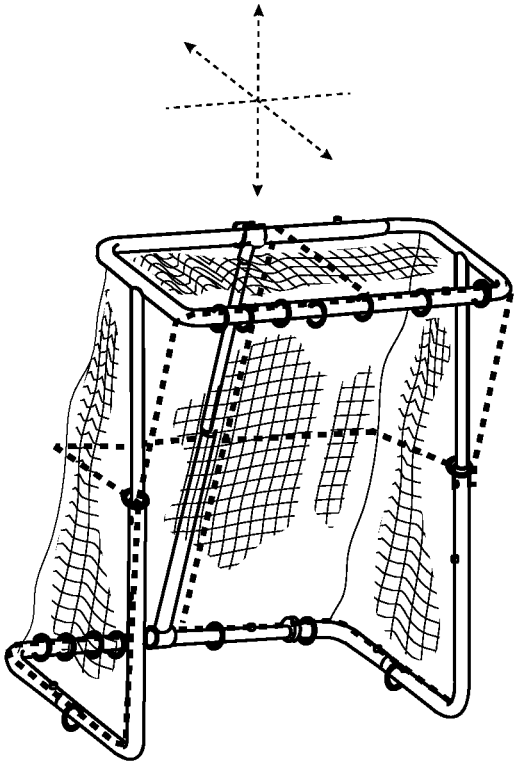
FIG. 8 is a configuration of the sports goal.
Figure 9:
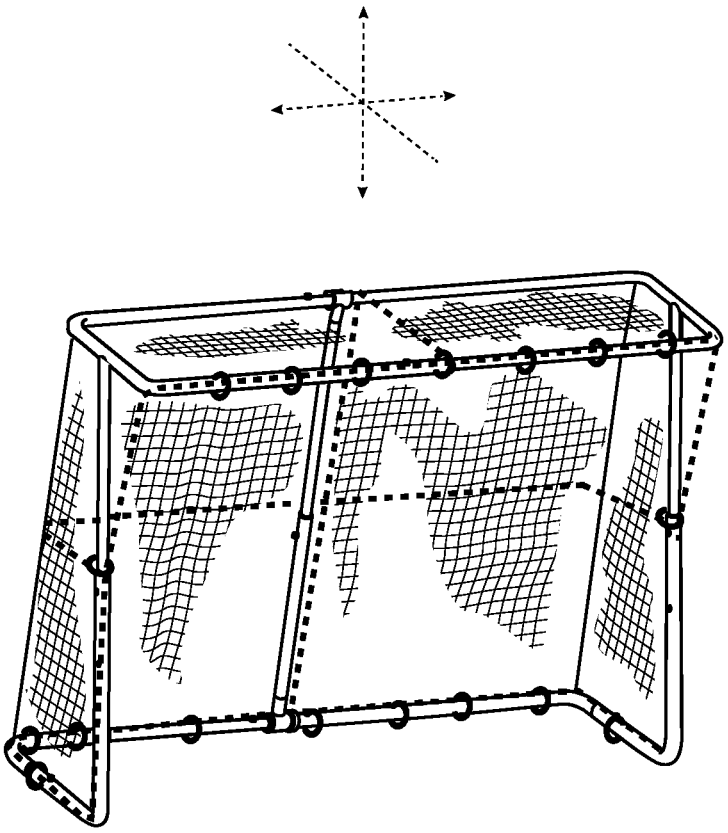
FIG. 9 is a configuration of the sports goal.
Figure 10:
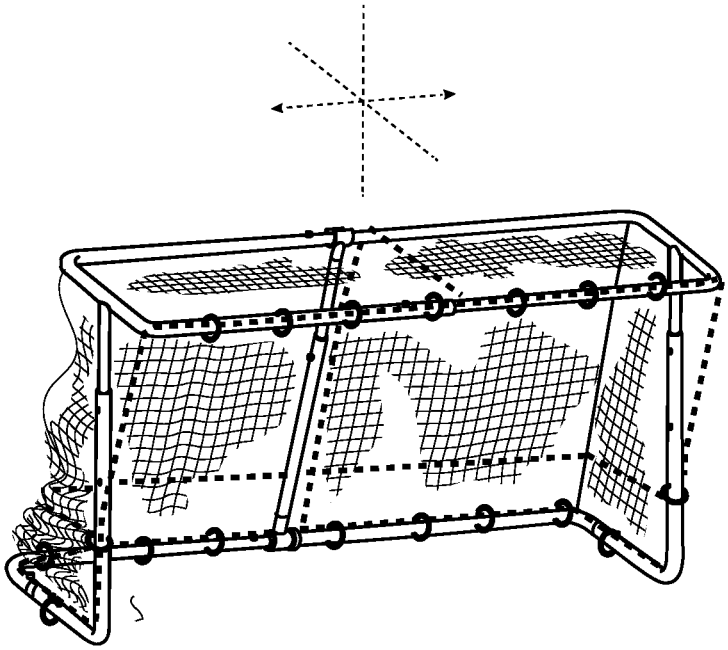
FIG. 10 is a configuration of the sports goal.
Figure 11:
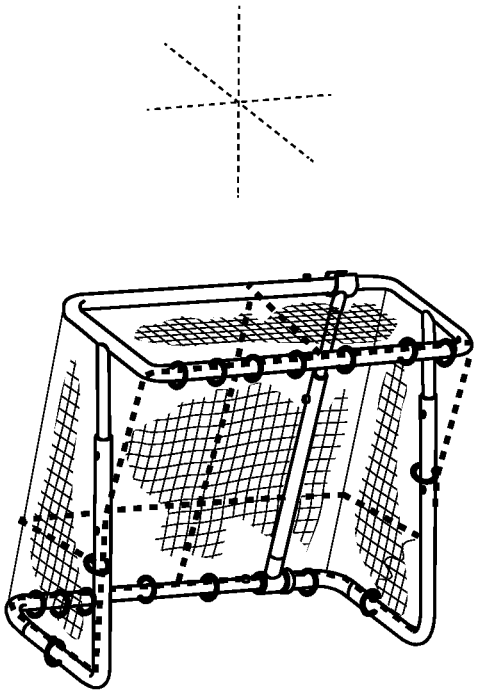
FIG. 11 is a configuration of the sports goal.
Figure 12:
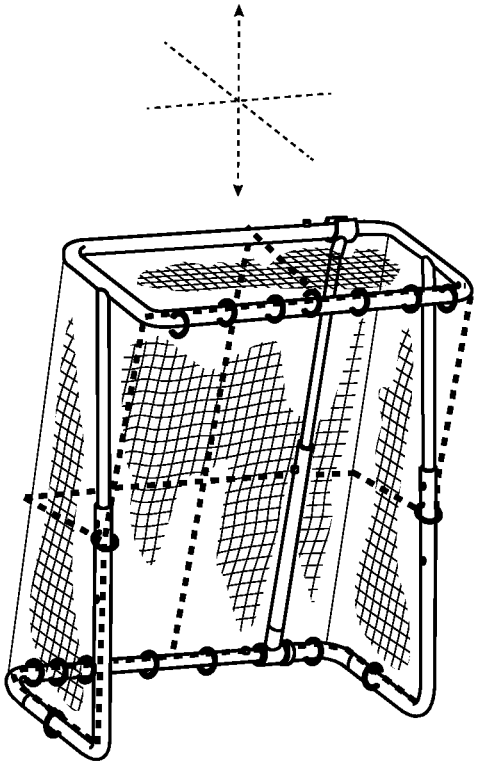
FIG. 12 is a configuration of the sports goal.

FIGS. 3 and 4 depict the assembled device 10 of FIG. 1. The device 10 is fully expanded in FIG. 3 and vertically V collapsed for contrast in FIG. 4. By comparing FIGS. 1 and 2 with FIGS. 3 and 4, the assembly and operation of the device 10 is disclosed. Common to all the preferred embodiments depicted in FIGS. 1 through 4, the horizontal 11, 18, 32, central 38, longitudinal 19, and vertical support members 20, 27 forming the device 10 feature telescopic engagements to allow the device 10 to translate from an expanded position (as displayed in FIGS. 3 and 5) to a collapsed position (as illustrated in FIG. 4 but best depicted in FIGS. 6 through 12) without the need for any disassembly of the device 10. This provides easy set up, removal from a field, and storage or transport of the device 10 in a confined area like a trunk of a vehicle.

As shown in FIGS. 1-4 the general supporting structure of the goal 10 is preferably defined by: at least one upper or horizontal net support member 11; at least one lower horizontal base support member 18; preferably two longitudinal base support members 19; a central support member 38; and, two vertical support members 20, 27. The stated horizontal members 11, 18 are usually united by a first bended vertical support member 20/longitudinal support member 19 assembly and a second bended vertical support member 27/longitudinal member 19 assembly, whereby the bended assemblies are substantially perpendicular or normal to both of said horizontal members 11, 18, as seen in the drawings.

Still referring to FIGS. 1-4, a pair of longitudinal base supports 19 in the form of struts are engaged to distal ends of the vertical support members 20 and 27 and rearward away from the goal opening 44 which is defined by the two vertical members and the first horizontal net support member 11. The preferred mode of the device in all embodiments has the aforementioned base support member 18 extending from a connection between the rearward distal ends of the struts 19.

Still referring to FIGS. 1-4 the upper horizontal net support member is formed from receiving a plurality of at least two telescopically engaged components shown as receiving member 12 and a translating member 14, with the receiving member 12 having an interior axial cavity adapted to allow the translating member 14 to telescope therein. Likewise, the base support member 18 features translating member 16 and receiving member 17. Finally, the longitudinal base support member 19 may feature a translating member 15 and receiving member 21.

Also depicted in FIGS. 1 through 4, the first vertical support member 20 is formed in a similar configuration of a plurality of at least two components shown as a receiving member 22 portion telescopically engaging over a translating member 24. Also, in a similar operational configuration the second vertical support member 27 is formed in at least two components with a receiving member 28 adapted for telescopic engagement over the translating member 30.

Further shown by FIGS. 1-4, in the favored embodiments herein is a second horizontal net support member 32 formed of a plurality of at least two components in the form of a receiving member 34 and translating member 36. The second horizontal net support member 32, if employed as shown in all the favored embodiments, would be engaged with struts 33 in such a fashion as to position the second net support member 32 substantially parallel with the first net support member 11.

As shown in the FIGS. 1-4 and 5-12, a center support member 38 may also be employed for extra strength and rigidity of the device 10 when deployed. This component is included in the preferred mode of the device 10 and would operate in a similar fashion to all the other telescoping members 11, 18, 19, 20, 27, 32 forming the device 10. More specifically, the center support member 38 is formed from at least two telescopic components shown as a receiving member 42 portion of the center support member 38 would translatably engage with a translating member 40 portion. At least one distal end of the center support member 38 is preferably rotationally engaged using a c-collar 43 that rotates on its engagement to the respective horizontal member on which it is engaged (usually either horizontal member 32 and base support member 18) to allow for easy transition to a vertically V or longitudinally L collapsed position. If both ends are engaged with such a collar 43, the center support member 38 will still supply the added angled support while allowing the support member 38 to telescope for collapsing the device 10 vertically. When the c-collars 43 are engaged, the central support member 38 may suitably slide along the horizontal support members 18, 32 for repositioning of the central member. See, e.g., FIGS. 7 and 8. In view of this sliding feature, the receiving member 17 of may be outfitted with a safety collar 200 so that the central support may not slide onto the translating member 16 and disengage from the support 10 in view of the translating member's smaller diameter.

FIGS. 4 and 3 depict the device 10 as would be assembled from the depicted parts of FIG. 1 into a goal support 10 for a net 100, by sliding the respective vertical 24, 28, horizontal 14, 16, 36, and longitudinal 15 translating members into an engagement with the respective receiving members. In the case of all support members 11, 18, 19, 20, 27, 32 a means for locking the translating portion 14, 16, 15, 24, 28, 36 into position within the receiving portion 12, 17, 21, 24, 30, 34 of the respective members 11, 18, 19, 20, 27, 32 may preferably be employed as a means to maintain the device 10 in an expanded position for use.

FIGS. 3 and 4 show a net 100 engaged on the device 10 of FIG. 1. As shown, the net 100 may be fit over the goal 10 so that the elastic cord 140 is positioned around the opening 44 of the goal 10, and so that the elastic cords 150, 160 generally run along the center of the goal 10, as shown. Suitably, the net may be secured to the goal 10 via a plurality of loops 190 secured around the elastic cord 140, the horizontal members 11, 18, the longitudinal members 19, and the vertical member 20, 27. In operation, the elastic cords 140, 150, 160 constrict to gather slack from the net 100 when the goal 10 is collapsed. In a preferred embodiment, the loops 190 may be slidably repositioned along the support members 11, 18, 19, 20 27 so that the slack of the net is managed along the support members 11, 18, 19, 20 27. In a preferred embodiment, the elastic cords 140, 150, 160 are bungee cords, but any elastic cord will suffice. In another embodiment, the loops 190 are made of elastic, but rigid or non-rigid materials may also make up the loops (e.g., metals, plastics, rubbers, nylon, and the like).

The device 10 as shown and described would thus be easily stored in the collapsed position where it would occupy substantially less than 60% of its volumetric size in the expanded position where it would be used for a game with the net attached. Transition from the collapsed position to the expanded position, and back, is easily accomplished without the need to disassemble any of the various horizontal and vertical members forming the device 10 since they are all respectively telescopically engaged and substantially perpendicular to each other. The user simply needs to disengage the means to hold the components of the device 10 in the expanded position and collapse the device in at least two planes to the smaller collapsed position. Once so collapsed, it is easily stored or transported. An additional benefit of not having to separate the parts to collapse the device 10 is provided by the fact that the goal net may remain attached during storage in the collapsed position since none of the various members forming the device 10 need be removed or disengaged.

FIGS. 5-12 diagram a few configurations of the goal 10, attainable via selective telescoping of the support structure. More specifically, in the figures: configuration 11 is a goal 10 collapsed in all planes and represents a reference for all the other depicted configurations; 12 has been expanded vertically from 11; 9 has been expanded vertically and longitudinally from 11 while 7 has only been expanded longitudinally therefrom; 6 has been expanded longitudinally and horizontally from 11, but 10 has only been expanded horizontally; 9 has been expanded horizontally and vertically from 11; and, 5 has been expanded in all three planes.

Figure 13:
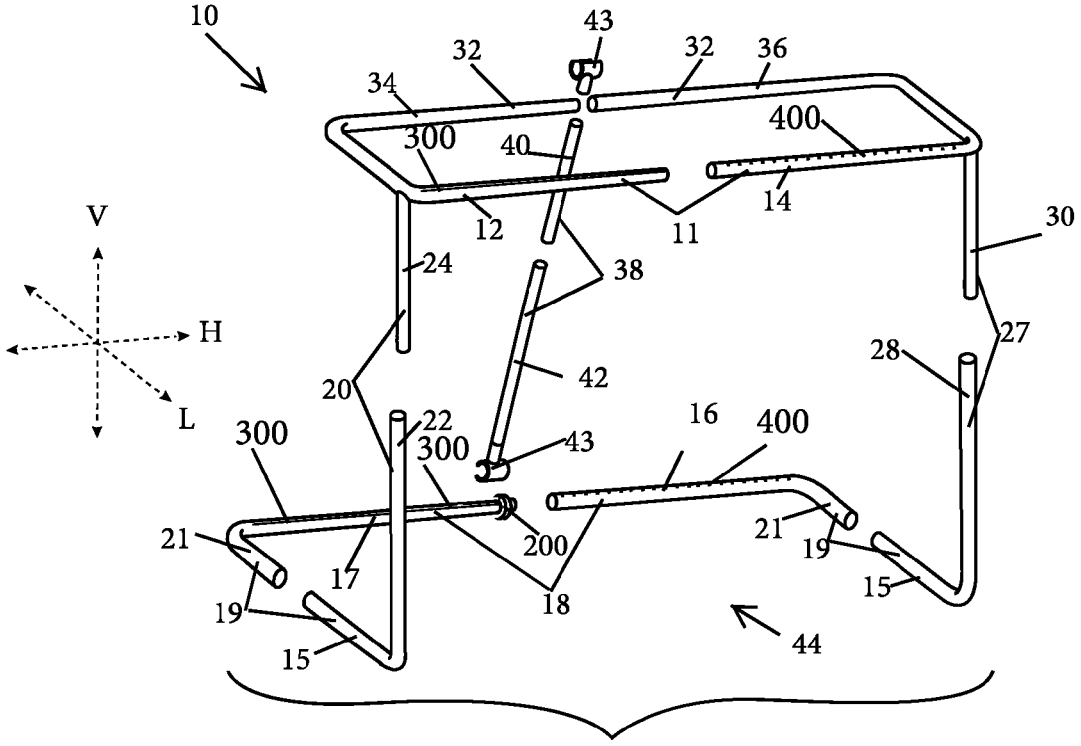
FIG. 13 displays an exploded view of another preferred embodiment of the device collapsible along three axises employing the telescopic translating engagement of the other embodiments with base struts also being telescopic.

FIG. 13 displays an exploded view of an alternate embodiment of the device 10 wherein such is collapsible in three directions along the vertical V, longitudinal L, and horizontal H axises. This device 10 is substantially the same as the device described in connection with the earlier FIGS. 1 through 12. As in the earlier embodiment, collapsibility of the device 10 shown is accomplished via telescopic means at strategic positions around the supporting structure of the device 10. Of course, additional smaller members making up the various telescopic components may make the device 10 collapsible to a smaller collapsed position and such is anticipated. The current preferred mode typically collapses along its axises via two telescoping components, for simplicity and to avoid the problems inherent to more moving parts. The difference between the present device 10 and the earlier described embodiment is that: (1) the horizontal members 12 and 34 feature a slit 300; horizontal members 14 and 36 feature apertures 400; and (2) vertical member 22 features a vertical slit (not shown) on its backside (not shown). As discussed in greater detail below, the slits and apertures are for adjustably securing a net 100 to the device 10.

Figure 14:
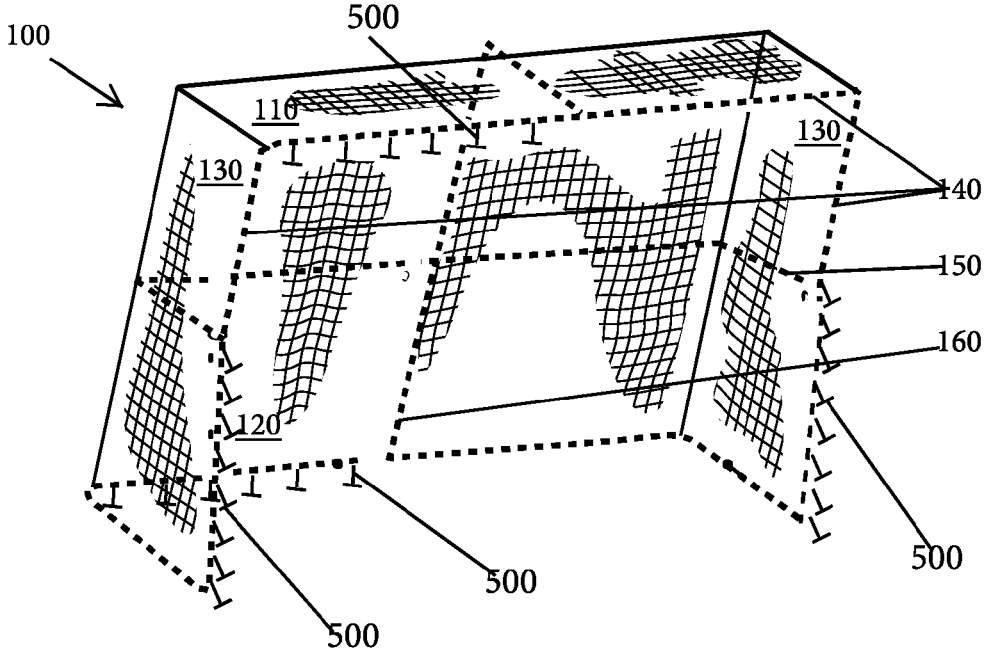
FIG. 14 depicts a net for the device depicted in FIG. 13.

FIG. 14 depicts a net 100 for engaging the device 10 of FIG. 13. As shown, the net 100 is generally defined by a top panel 110, back panel 120, and side panels 130. The panels 110, 120, 130 may be seamlessly interconnected as shown. In a preferred embodiment, the netting 100 features: (1) a cord 140 (shown in broken line) (elastic or otherwise) sewn into its edges; (2) an equatorial elastic cord 150 (shown in broken lines) sewn horizontally through its mid-section; and (3) a latitudinal elastic cord 160 (shown in broken lines) sewn through its vertical midsection. The net 100 further features anchors 500 for, as discussed below, slidably engaging horizontal and vertical slots in the vertical and horizontal members of the device shown in FIG. 13. As discussed below, the net 100 is configured to engage the device 10 of FIG. 13 by sliding the anchors through the horizontal and vertical slots 300 in the device 10 (shown in FIG. 13) and tying the net 100 to the device 10 via apertures 400 (shown in FIG. 13).

Figure 15:
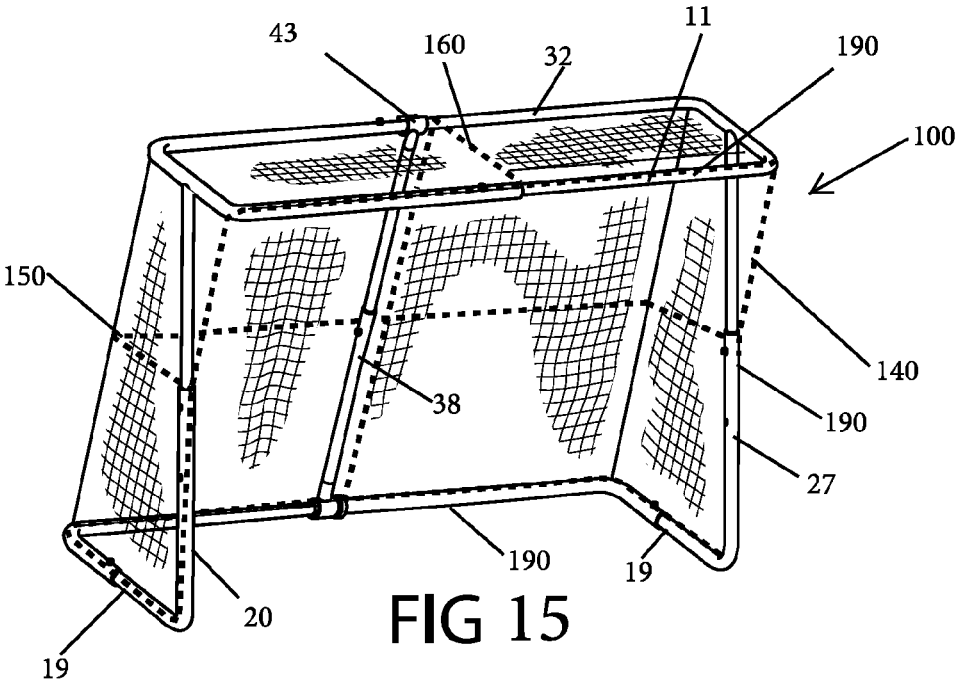
FIG. 15 depicts the device in an expanded position with net of FIG. 14 engaged.
Figure 16:
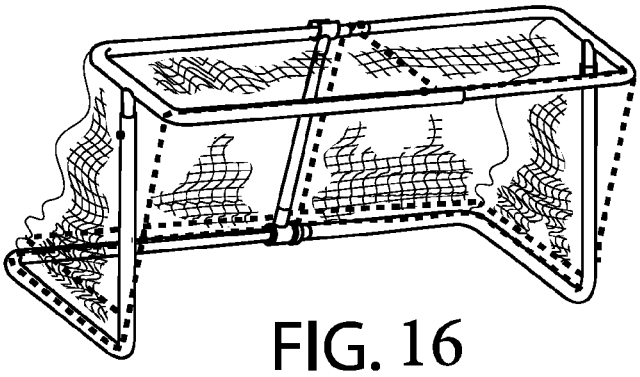
FIG. 16 provides a perspective example of the device in a collapsed configuration where the net may remain engaged.
Figure 17:
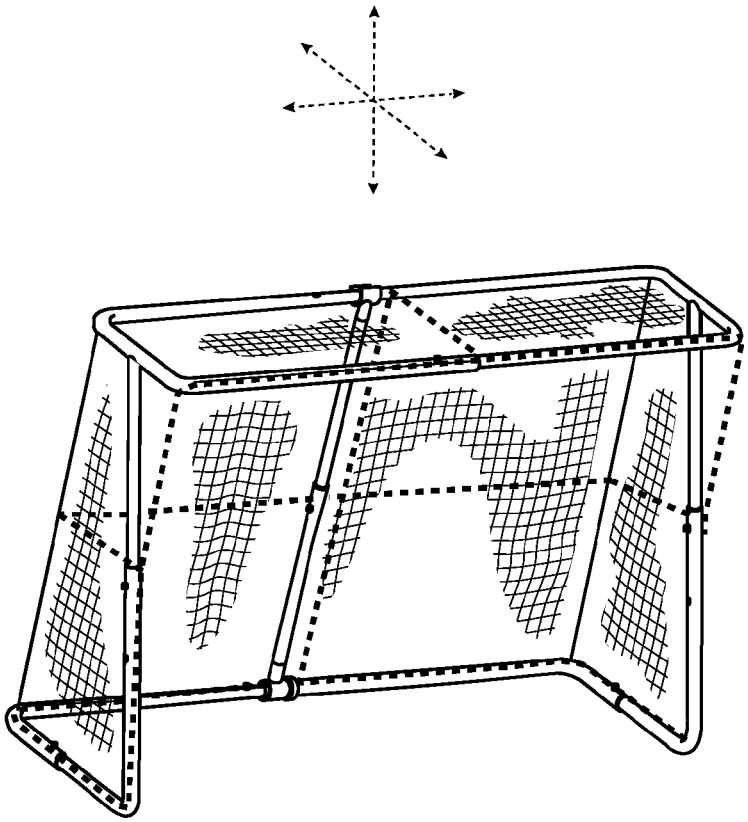
FIG. 17 is a configuration of the sports goal.
Figure 18:
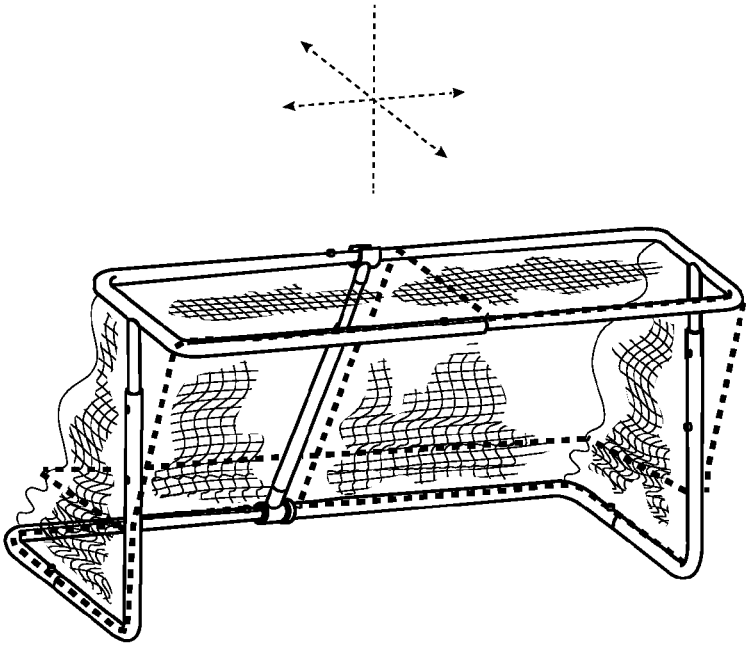
FIG. 18 is a configuration of the sports goal.
Figure 19:
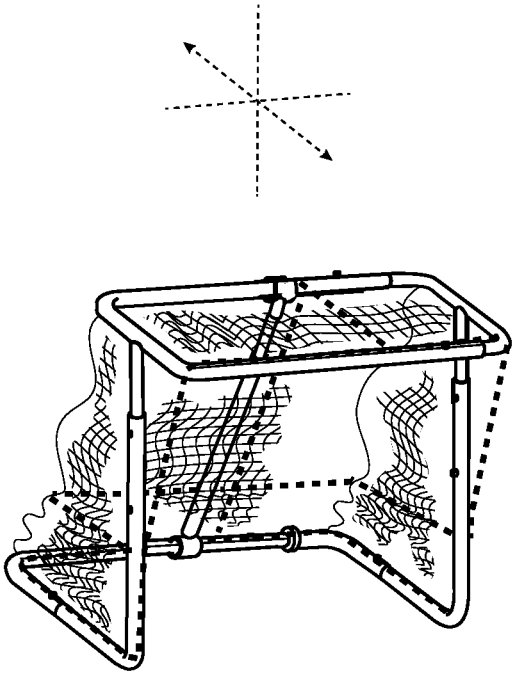
FIG. 19 is a configuration of the sports goal.
Figure 20:
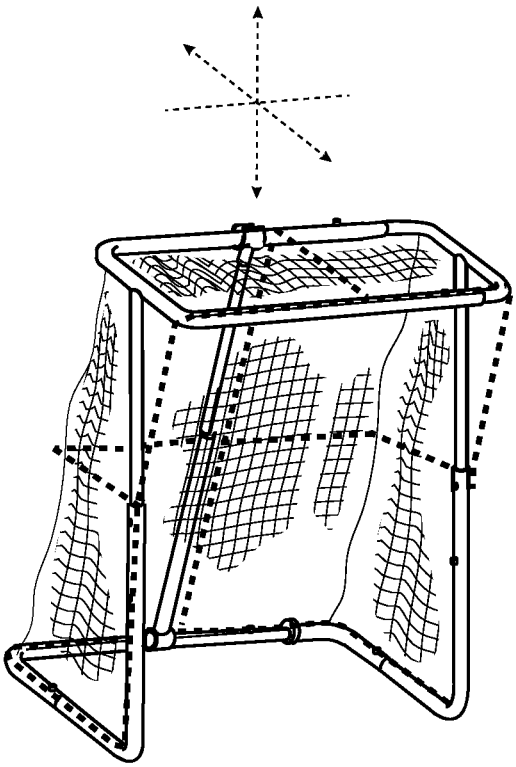
FIG. 20 is a configuration of the sports goal.
Figure 21:
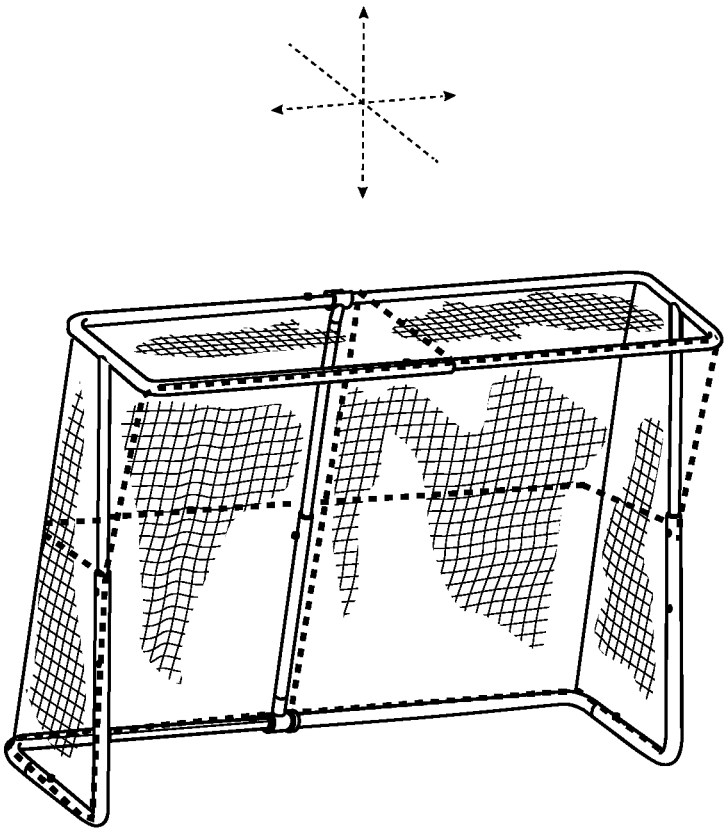
FIG. 21 is a configuration of the sports goal.
Figure 22:
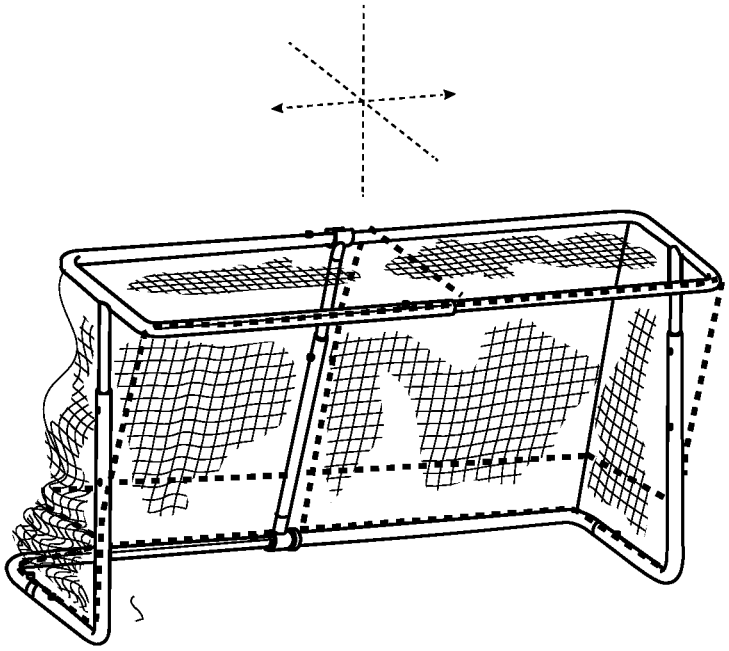
FIG. 22 is a configuration of the sports goal.
Figure 23:
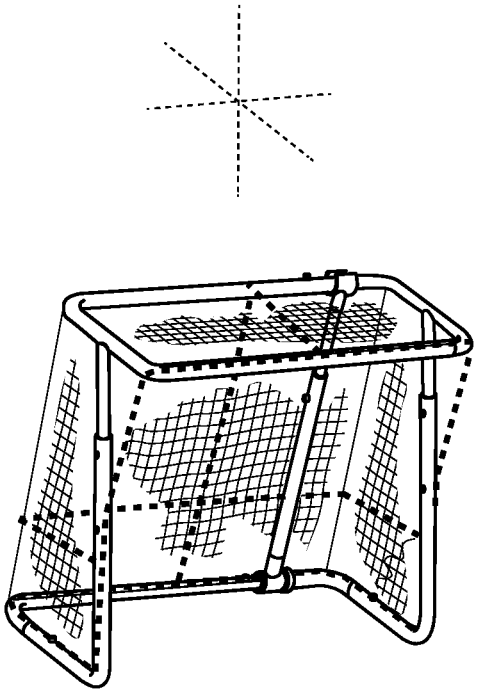
FIG. 23 is a configuration of the sports goal.
Figure 24:
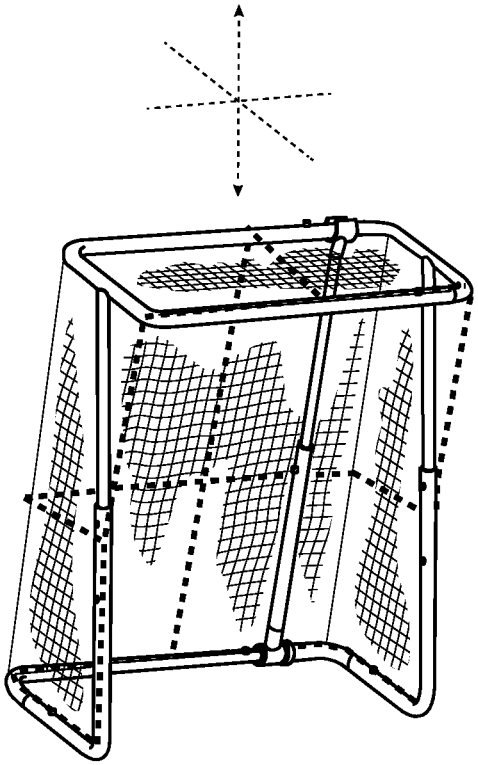
FIG. 24 is a configuration of the sports goal.

FIGS. 15 and 16 depict the assembled device 10 of FIGS. 13 and 14. The device 10 is fully expanded in FIG. 15 and vertically V collapsed for contrast in FIG. 16. By comparing FIGS. 13 and 14 with FIGS. 15 and 16, the assembly and operation of the device 10 is disclosed. Common to all the preferred embodiments depicted in FIGS. 13 through 16, the horizontal 11, 18, 32, central 38, longitudinal 19, and vertical support members 20, 27 forming the device 10 feature telescopic engagements to allow the device 10 to translate from an expanded position (as displayed in FIGS. 15 and 17) to a collapsed position (as illustrated in FIG. 16 but best depicted in FIGS. 18 through 24) without the need for any disassembly of the device 10. This provides easy setup, removal from a field, and storage or transport of the device 10 in a confined area like a trunk of a vehicle.

As shown in FIGS. 13-16 the general supporting structure of the goal 10 is preferably defined by: at least one upper or horizontal net support member 11; at least one lower horizontal base support member 18; preferably two longitudinal base support members 19; a central support member 38; and, two vertical support members 20, 27. The stated horizontal members 11, 18 are usually united by a first bended vertical support member 20/longitudinal support member 19 assembly and a second bended vertical support member 27/longitudinal member 19 assembly, whereby the bended assemblies are substantially perpendicular or normal to both of said horizontal members 11, 18, as seen in the drawings.

Still referring to FIGS. 13 through 16, a pair of longitudinal base supports 19 in the form of struts are engaged to distal ends of the vertical support members 20 and 27 and rearward away from the goal opening 44 which is defined by the two vertical members and the first horizontal net support member 11. The preferred mode of the device in all embodiments has the aforementioned base support member 18 extending from a connection between the rearward distal ends of the struts 19.

Still referring to FIGS. 13-16 the upper horizontal net support member is formed from receiving a plurality of at least two telescopically engaged components shown as receiving member 12 and a translating member 14, with the receiving member 12 having an interior axial cavity adapted to allow the translating member 14 to telescope therein. Likewise, the base support member 18 features translating member 16 and receiving member 17. Finally, the longitudinal base support member 19 may feature a translating member 15 and receiving member 21.

Also depicted in FIGS. 13 through 16, the first vertical support member 20 is formed in a similar configuration of a plurality of at least two components shown as a receiving member 22 portion telescopically engaging over a translating member 24. Also, in a similar operational configuration the second vertical support member 27 is formed in at least two components with a receiving member 28 adapted for telescopic engagement over the translating member 30.

Further shown by FIGS. 13-16, in the favored embodiments herein is a second horizontal net support member 32 formed of a plurality of at least two components in the form of a receiving member 34 and translating member 36. The second horizontal net support member 32, if employed as shown in all the favored embodiments, would be engaged with struts 33 in such a fashion as to position the second net support member 32 substantially parallel with the first net support member 11.

As shown in the FIGS. 13-16 and 17-24, a center support member 38 may also be employed for extra strength and rigidity of the device 10 when deployed. This component is included in the preferred mode of the device 10 and would operate in a similar fashion to all the other telescoping members 11, 18, 19, 20, 27, 32 forming the device 10. More specifically, the center support member 38 is formed from at least two telescopic components shown as a receiving member 42 portion of the center support member 38 would translatably engage with a translating member 40 portion. At least one distal end of the center support member 38 is preferably rotationally engaged using a c-collar 43 that rotates on its engagement to the respective horizontal member on which it is engaged (usually either horizontal member 32 and base support member 18) to allow for easy transition to a vertically V or longitudinally L collapsed position. If both ends are engaged with such a collar 43, the center support member 38 will still supply the added angled support while allowing the support member 38 to telescope for collapsing the device 10 vertically. When the c-collars 43 are engaged, the central support member 38 may suitably slide along the horizontal support members 18, 32 for repositioning of the central member. See, e.g., FIGS. 19 and 20. In view of this sliding feature, the receiving member 17 of may be outfitted with a safety collar 200 so that the central support may not slide onto the translating member 16 and disengage from the support 10 in view of the translating member's smaller diameter.

FIGS. 16 and 15 depict the device 10 as would be assembled from the depicted parts of FIG. 13 into a goal support 10 for a net 100, by sliding the respective vertical 24, 28, horizontal 14, 16, 36, and longitudinal 15 translating members into an engagement with the respective receiving members. In the case of all support members 11, 18, 19, 20, 27, 32 a means for locking the translating portion 14, 16, 15, 24, 28, 36 into position within the receiving portion 12, 17, 21, 24, 30, 34 of the respective members 11, 18, 19, 20, 27, 32 may preferably be employed as a means to maintain the device 10 in an expanded position for use.

FIGS. 15 and 16 show a net 100 engaged on the device 10 of FIG. 13. As shown, the net 100 may be fit over the goal 10 so that the cord 140 is positioned around the opening 44 of the goal 10, and so that the elastic cords 150, 160 generally run along the center of the goal 10, as shown. Suitably, the net may be secured to the goal 10 via slidably providing anchors 500 (shown in FIG. 2) secured around the cord 140 into the slit 300 of the horizontal members 11, 18, and the vertical member 20, 27 (slit not shown because it is on the backside of the vertical members 20, 27). In operation, the elastic cord 150, 160 constrict to gather slack from the net 100 when the goal 10 is collapsed while the anchors slide along the slits 300. In a preferred embodiment, the anchors 500 may be slidably repositioned along the support members 11, 18, 19, 20 27 so that the slack of the net is managed along the support members 11, 18, 19, 20 27. In a preferred embodiment, the elastic cords 150, 160 are bungee cords, but any elastic cord will suffice.

The device 10 as shown and described would thus be easily stored in the collapsed position where it would occupy substantially less than 60% of its volumetric size in the expanded position where it would be used for a game with the net attached. Transition from the collapsed position to the expanded position, and back, is easily accomplished without the need to disassemble any of the various horizontal and vertical members forming the device 10 since they are all respectively telescopically engaged and substantially perpendicular to each other. The user simply needs to disengage the means to hold the components of the device 10 in the expanded position and collapse the device in at least two planes to the smaller collapsed position. Once so collapsed, it is easily stored or transported. An additional benefit of not having to separate the parts to collapse the device 10 is provided by the fact that the goal net may remain attached during storage in the collapsed position since none of the various members forming the device 10 need be removed or disengaged.

FIGS. 17-24 diagram a few configurations of the goal 10, attainable via selective telescoping of the support structure. More specifically, in the figures: configuration 11 is a goal 10 collapsed in all planes and represents a reference for all the other depicted configurations; 12 has been expanded vertically from 11; 9 has been expanded vertically and longitudinally from 11 while 7 has only been expanded longitudinally therefrom; 6 has been expanded longitudinally and horizontally from 11, but 10 has only been expanded horizontally; 9 has been expanded horizontally and vertically from 11; and, 5 has been expanded in all three planes.

Although the invention has been described with respect to particular embodiments thereof, it should be realized that various changes and modifications may be made therein without departing from the spirit and scope of the invention. While the invention as shown in the drawings and described in detail herein discloses arrangements of elements of particular construction and configuration for illustrating preferred embodiments of structure and method of operation of the present invention, it is to be understood, however, that elements of different construction and configuration and other arrangements thereof, other than those illustrated and described, may be employed in accordance with the spirit of this invention. Any and all such changes, alterations and modifications, as would occur to those skilled in the art, are considered to be within the scope of this invention as broadly defined in the appended claims.

The utility model is described according to one embodiment. Without departing from the principles of the utility model, the device can be adjusted to accomplish various other embodiments. It should be pointed out that any technical solution or equivalent transformation all fall within the scope of the protection of utility models. It is to also be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

While the invention has been shown in a preferred embodiment, including a generally tubular or inverted truncated cone-shaped cup, it is recognized that departures may be made in the form of the cup and the mating matching rings to accommodate a square-shaped cup, for example; and it is further recognized that departures may be made from the invention as described within the spirit of this invention which is therefore not to be limited except as set forth in the claims which follow.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A method of collapsing a sports goal comprising the steps of: obtaining a net defined by a top panel, back panel, and side panels that are interconnected as a single unit, said net further comprising: (1) a cord provided along edges of the unit; (2) an equatorial elastic cord provided horizontally through a mid-section of the unit; and (3) a vertical elastic cord provided through a vertical midsection of the unit; obtaining a collapsible frame comprising at least one upper horizontal net support member configured to telescopingly collapse in a horizontal dimension, at least one lower horizontal base support member configured to telescopingly collapse in the horizontal dimension, said lower horizontal base support member includes a safety collar at a central location, two longitudinal base support members; a central support member that is rotatably and slidably coupled to said upper horizontal net support member, said central support member rotatably and slidably coupled to said lower horizontal base support member by a c-collar and configured to collapse in a vertical dimension while rotating at said c-collar; two vertical support members configured to telescopingly collapse in the vertical dimension, wherein a goal opening is formed by coupling (i) a first one of the two longitudinal base support members to a first end of the lower horizontal base support members and a first end of a first one of the two vertical support members, (ii) a second one of the two longitudinal base support members to a second end of the lower horizontal base support member and a first end of the second of the two vertical support members, (iii) the upper horizontal net support member to both a second end of a first vertical support member and a second end of a second vertical support member; providing the net around the collapsible frame; collapsing the frame in a horizontal dimension by both (a) telescopingly collapsing the upper horizontal net support member and the lower horizontal base support member and (b) sliding the c-collar of the central support member along the lower horizontal base support member in a horizontal direction relative to the safety collar on the lower horizontal base support member, so that while collapsing the frame in the horizontal dimension the equatorial elastic cord gathers any slack of the net in said horizontal dimension; wherein the lower horizontal base support member is defined by a translating member, a receiving member, and the safety collar on the receiving member; wherein the safety collar operates to retain the central support member during sliding movements so that the c-collar of the central member may not slide onto the translating member of the lower horizontal base support member; and, collapsing the frame in a vertical dimension by both (a) telescopingly collapsing the two vertical support members and (b) telescopingly collapsing the central support member while rotating the c-collar of the central support member relative to the lower horizontal base support member, so that while collapsing the frame in said vertical dimension said vertical elastic cord gathers any slack of the net in said vertical dimension.

2. The method of claim 1 further comprising the step of sliding a central support member of the frame into contact with the safety collar of the frame.

3. The method of claim 1 further comprising the steps of: securing the net to the frame via loops positioned on the lower horizontal base support member of the frame; and sliding said loops along said lower horizontal base support member while the equatorial elastic cord is gathering slack of the net in the horizontal dimension.

4. The method of claim 3 further comprising the steps of:

securing the net to the frame via loops positioned on the first and second of the two vertical support members of the frame; and, sliding said loops along said first and second vertical support members while the vertical elastic cord is gathering slack of the net in the vertical dimension.

5. The method of claim 1 further comprising the steps of: wherein the lower horizontal base support member features a slot that is provided horizontally along the receiving member of the lower horizontal base support member between the safety collar and the first end of the lower horizontal base support member; securing the net to the frame via anchors positioned within a slot in the lower horizontal base support member of the frame; and sliding said anchors along a slot within said lower horizontal base support member while the equatorial elastic cord is gathering slack of the net in the horizontal dimension.

6. The method of claim 3 further comprising the steps of:

securing the net to the frame via anchors positioned within slots in the first and second vertical support members of the frame; and, sliding said anchors along said slots within said first and second vertical support members while the vertical elastic cord is gathering slack of the net in the vertical dimension.

* * * * *